US005915719A

United States Patent [19]

Bauvois

[11] Patent Number: 5,915,719

[45] **Date of Patent: *Jun. 29, 1999**

[54] BOARD FOR SLIDING OVER SNOW, COMPRISING A PLATFORM FOR RECEIVING AND ELEVATING THE BOOT BINDINGS

[75] Inventor: Jean Bauvois, Villars de Lans, France

[73] Assignee: Skis Rossignol, S.A., France

[ * ] Notice: This patent issued on a continued prosecution application filed under 37 CFR 1.53(d), and is subject to the twenty year patent term provisions of 35 U.S.C. 154(a)(2).

[21] Appl. No.: 08/644,054

[22] Filed: May 10, 1996

[30] Foreign Application Priority Data

May 22, 1995 [FR] France ..... 95 06333

[51] Int. Cl.[6] ..... A63C 5/00

[52] U.S. Cl. ..... 280/607; 280/608

[58] Field of Search ..... 280/607, 610, 280/617, 608

[56] References Cited

U.S. PATENT DOCUMENTS

| | | | |
|---|---|---|---|
| 3,580,596 | 5/1971 | Volkl | 280/608 |
| 4,294,460 | 10/1981 | Kirsch | 280/607 |
| 4,568,100 | 2/1986 | Eriksson | 280/607 |
| 4,678,200 | 7/1987 | Powel | 280/607 |
| 4,974,867 | 12/1990 | Rullier et al. | 280/607 |
| 5,143,395 | 9/1992 | Mayr | 280/607 |
| 5,346,244 | 9/1994 | Le Masson | 280/607 |
| 5,385,364 | 1/1995 | Nussbaumer | 280/607 |
| 5,447,322 | 9/1995 | Le Masson et al. | 280/610 |
| 5,480,175 | 1/1996 | Astier et al. | 280/607 |
| 5,538,271 | 7/1996 | Abondance | 280/617 |
| 5,687,983 | 11/1997 | Feketa et al. | 280/610 |

FOREIGN PATENT DOCUMENTS

| | | | |
|---|---|---|---|
| 245458 | 6/1965 | Austria | 280/608 |
| 2026233 | 12/1971 | Germany | 280/608 |
| 3223413 | 1/1983 | Germany | 280/608 |
| 3934888 | 5/1990 | Germany | 280/607 |
| 248512 | 5/1947 | Switzerland | 280/608 |

*Primary Examiner*—Thomas J. Brahan
*Attorney, Agent, or Firm*—Parkhurst & Wendel, L.L.P.

[57] ABSTRACT

A ski, or board for sliding on snow, having a platform for receiving and elevating the bindings of the boot including lateral edge protrusions which serve as feet for supporting this platform.

14 Claims, 5 Drawing Sheets

BOARD FOR SLIDING OVER SNOW, COMPRISING A PLATFORM FOR RECEIVING AND ELEVATING THE BOOT BINDINGS

FIELD OF THE INVENTION

The present invention relates to a board for sliding over snow, such as a ski, monoski, surf or like snow board, which comprises, in its binding mounting area, a platform for receiving and elevating the bindings of the skier's boot.

BACKGROUND OF THE INVENTION

It is known to add on a ski a platform for elevating the bindings of the boot, in the form of an elevating plate which is added in the binding mounting area and on the upper surface of the ski via a layer of material having shock-absorbing properties, typically a layer of visco-elastic material.

"Elevating platform" is understood to mean a platform providing effective elevation of the bindings, and therefore formed by a plate whose total thickness, including that of the intermediate visco-elastic layer, is greater than 5 millimeters.

Such elevating plates are now necessary due to the present reduction, at the level of the binding mounting area, of the width of modern downhill skis, one consequence of which is a risk of the ski skidding in a tight bend, as the boot, which projects laterally, then touches the snow whenever contact of the edge is great. With a sufficient superelevation, there is virtually no longer any risk of the boot contacting the snow whenever the ski inclines considerably to the side, and the ski may therefore be used normally, particularly in slalom.

Apart from these functions of elevation of the boot and of damping the vibrations, this elevating plate presents, or may present, interesting additional functions, such as, maintaining bendability of the ski.

In fact, in order to hold the skier's boot, the front stop and the heel of the binding system exert opposing thrusts on the rigid sole of the boot, which has for its effect to bend and rigidify the ski, therefore to modify the behavior thereof during skiing. This tension due to the springs of the binding exerts a moment of force which, without an intermediate plate, bends the ski. In that case, the bindings therefore tend to modify the characteristics of the ski, which is a drawback, as the camber of the ski came under particular study when each ski was designed by the manufacturer. With the elevating plate, the forces due to the bindings are then exerted on this plate which is sufficiently rigid that the plate does not retransmit the forces to the structure of the ski.

On the other hand, for all-purpose skis for example, the plate may be designed in order, in rest position, to exert a pre-tension at each end by two screw-adjustable stops, thus generating an effect of adjustment of the camber of the ski as a function of the weight of the skier or his/her technical level.

The plate may also improve precision of the ski.

It is a particular object of the present invention to improve the transmission of the forces between the binding, supported by the platform, and the edges, or lower lateral arrises, of the ski or like snow board. In addition, the present invention proposes a ski incorporating an elevated platform and side edge elements, for which the means for supporting this platform is made simply and harmoniously as it blends with the very structure of the ski, virtually integrating therewith while eliminating the parasitic effects of the intermediate elements.

SUMMARY OF THE INVENTION

The present invention relates to a ski, or like board for sliding on snow, comprising, in its binding mounting area, a rigid platform for receiving and elevating the bindings of the boot, this board being provided, at least in its binding mounting area, with rigid lateral edge elements, and being characterized in that these lateral edge elements each present one or more excrescences which project upwardly from the upper level of the surface of the ski and which are arranged to constitute all or part of the feet for supporting said platform for receiving and elevating the bindings of the boot.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
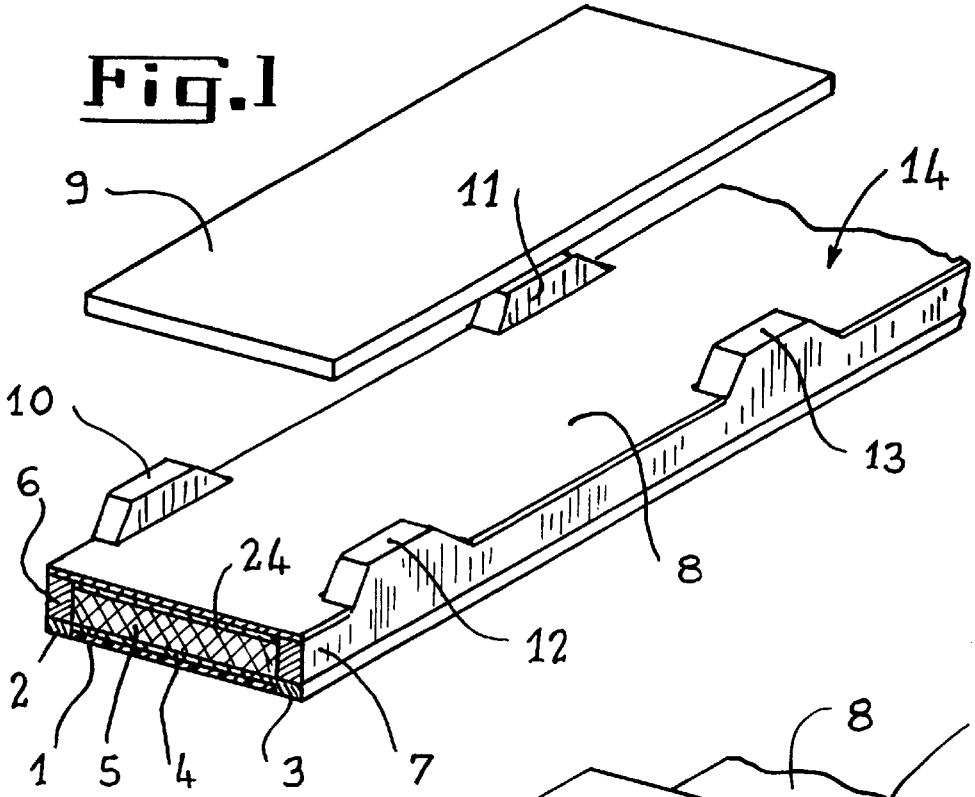
FIG. 1 is an exploded view in perspective, with partial section, of the binding mounting area of a ski according to the invention, the platform not yet being added on the ski.
Figure 2:
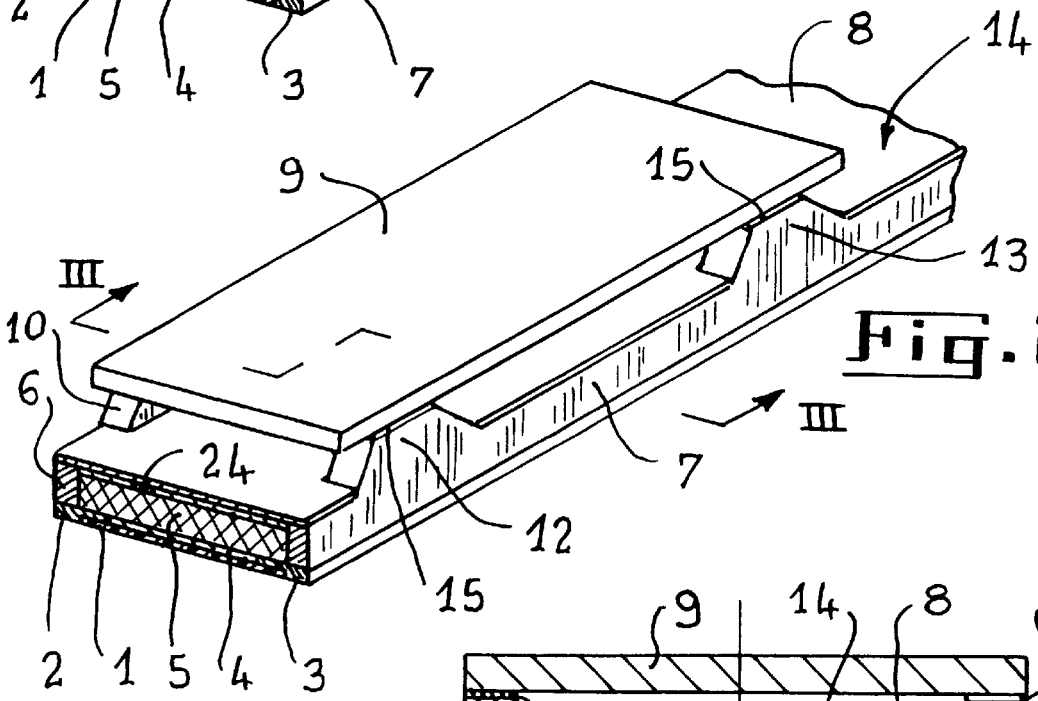
FIG. 2 is a non-exploded view in perspective, similar to FIG. 1 and showing the platform finally added on the ski.
Figure 3:
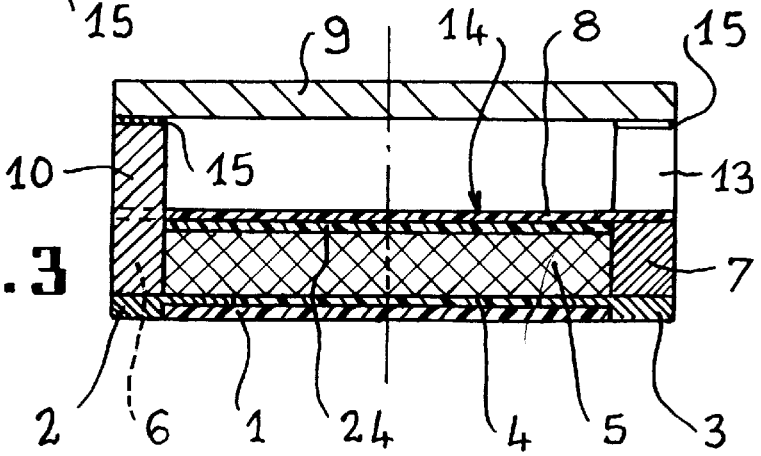
FIG. 3 is a view in section along broken line III—III of FIG. 2.

Referring now to the drawings, and firstly to FIGS. 1 to 3, they show a traditional, so-called "sandwich" structure ski, of which only the binding mounting area (i.e. the substantially median zone which receives the bindings of the boot) is shown here.

The structure of this traditional ski conventionally comprises:

- a sole 1 for sliding, bordered on either side by lower metal edges 2, 3,
- a lower reinforcing element 4,
- a solid core 5 bordered on either side by solid lateral edge elements 6 and 7,
- an upper reinforcing element 24, and
- a protective and decorative upper layer 8.

A rigid plate or platform 9 is provided to receive the bindings of the boot, such bindings not being shown in the drawing.

This rigid plate 9 is centred in the binding mounting area, of which, moreover, it occupies virtually the whole.

According to the invention, the lateral edge elements 6 and 7 each present, in the present case in the binding mounting area, two excrescences, 10, 11 and 12, 13 respectively, which project upwardly from the upper level of the upper surface 14 of the ski, and which are positioned and shaped to constitute four feet for supporting the rigid plate or platform 9.

As shown in the Figures, the upper layer 8 is interrupted locally to leave room for excrescences 10 to 13.

In accordance with FIGS. 2 and 3, the platform 9 is joined to these four feet 10 to 13 by gluing. Such gluing may advantageously be effected with the aid of a layer 15 of visco-elastic material or of elastic material, which makes it possible to improve the suppleness of the ski-platform bond, and to constitute an element for damping vibrations.

It should be noted that the transmission, to the edges 2 and 3 and therefore to the snow, of the forces exerted by the skier's boot is excellent here, as the edges, the edge elements and the feet of the platform form, on each side of the ski, an integral and virtually rigid assembly.

In practice, the excrescences 10 to 13 which form the four feet of the platform 9 project by some millimeters from the upper surface 14 of the ski.

Figure 4:
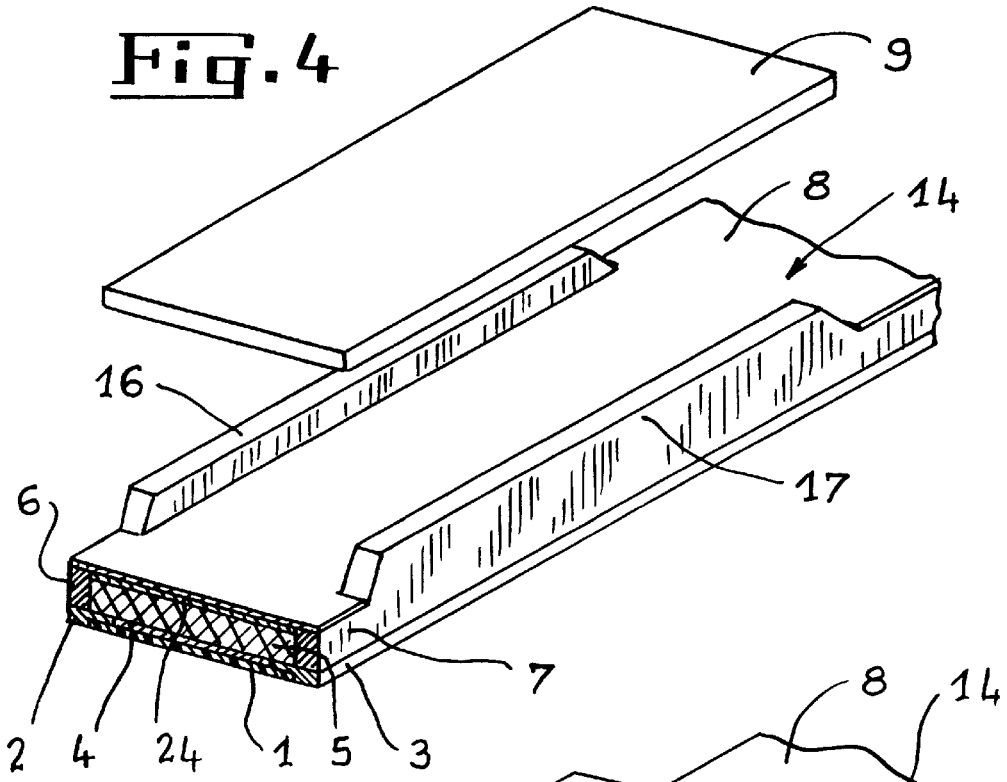
FIGS. 4 to 6 are views respectively similar to FIGS. 1 to 3, and showing a variant embodiment of this same ski.
Figure 5:
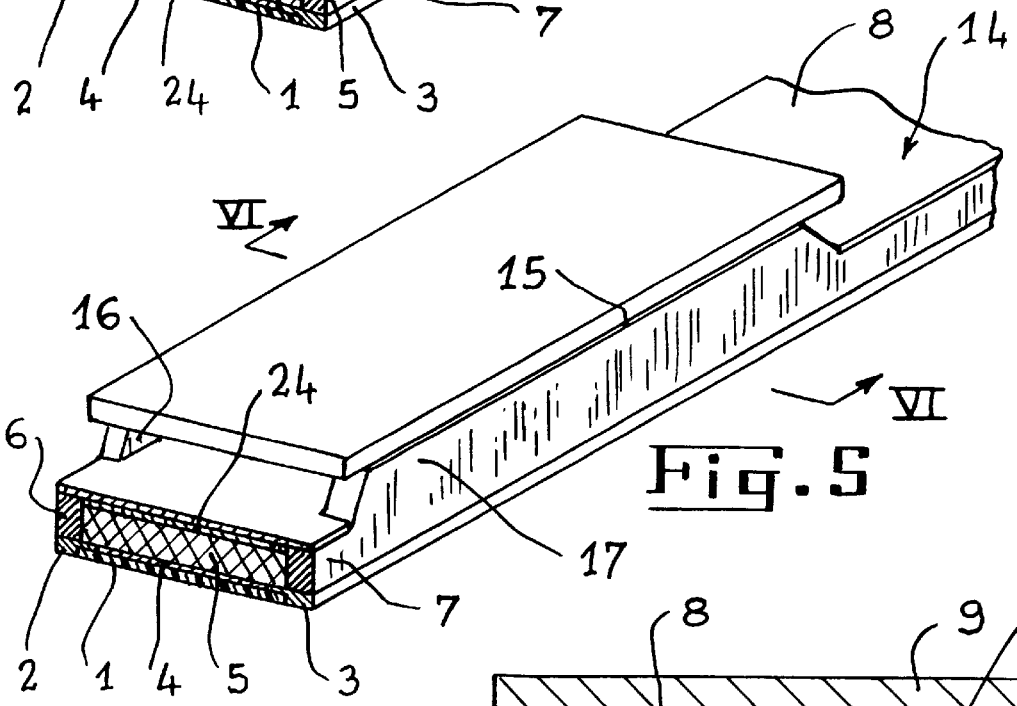
Figure 6:
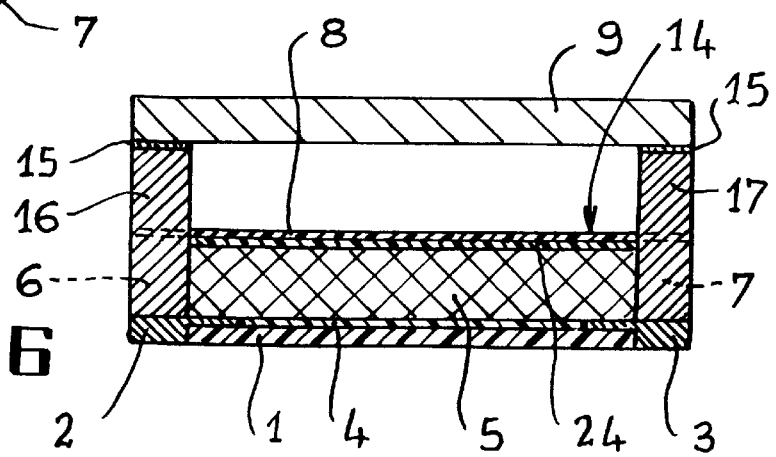

The embodiment according to these FIGS. 1 to 3 provides four distinct feet 10 to 13 for the platform 9. This is not limiting and, by way of example, FIGS. 4 to 6 illustrate an embodiment similar to the one which has just been described, but for which the edge elements 6 and 7 each comprise only one respective long excrescence 16, 17 which replaces the two preceding feet 10, 11 and 12, 13, respectively, filling the longitudinal space which separates them. The plate 9 is in that case supported by two feet 16, 17 instead of four, these two feet being simply very elongated, of a length close to that of the plate 9. This embodiment has the advantage of simplicity, but the previous embodiment appears preferable as it causes less rigidification of the ski.

Figure 7:
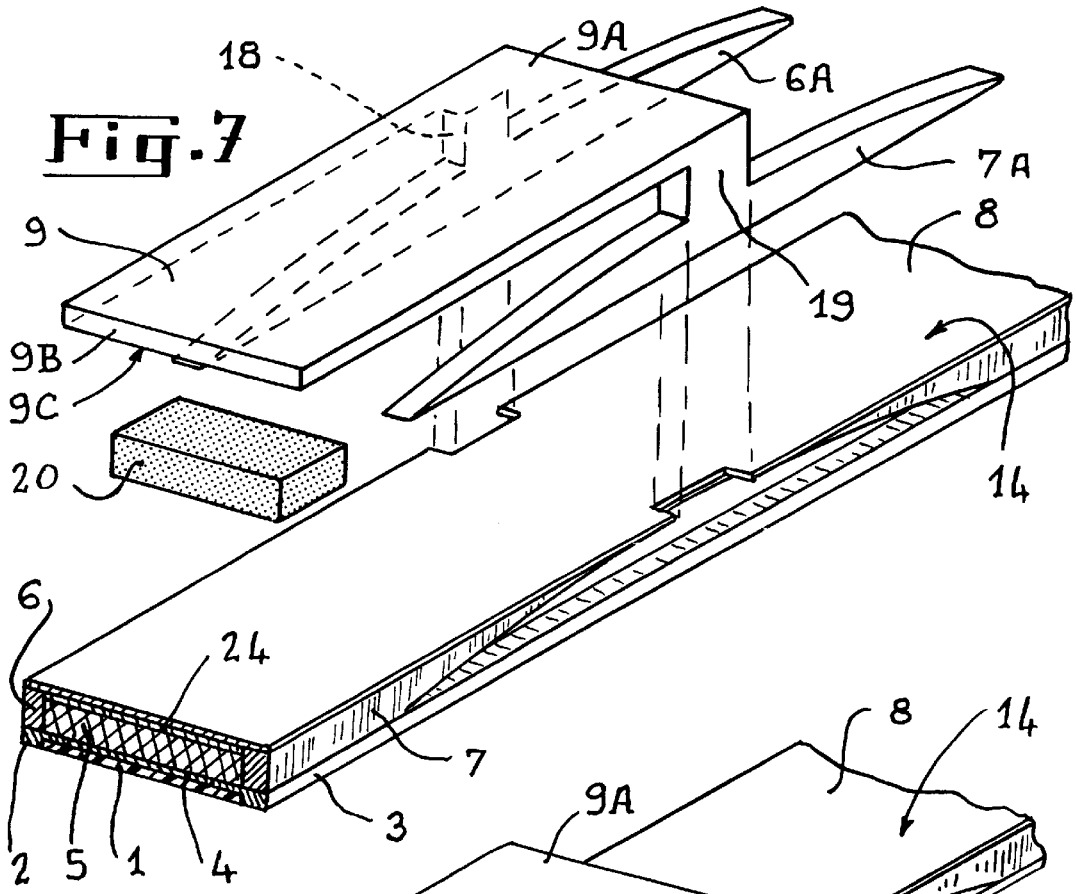
FIGS. 7 to 9 are views respectively similar to FIGS. 1 to 3, and illustrating another embodiment.
Figure 8:
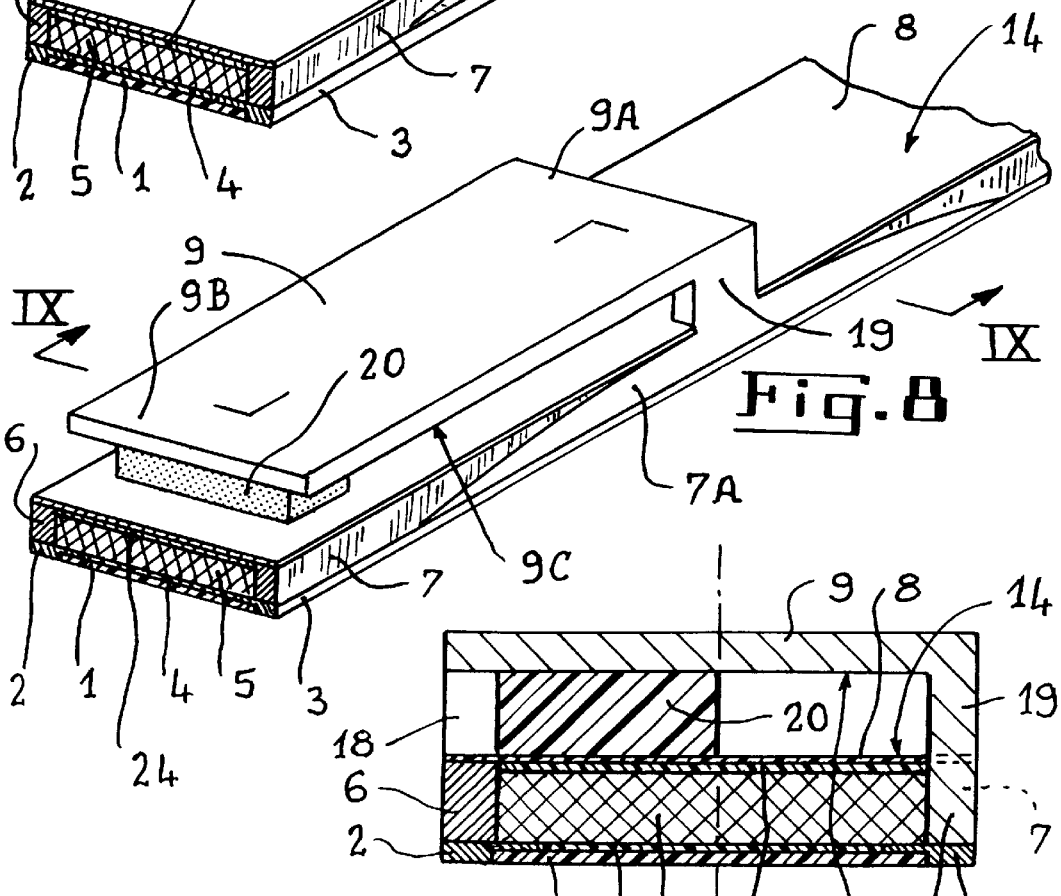
Figure 9:
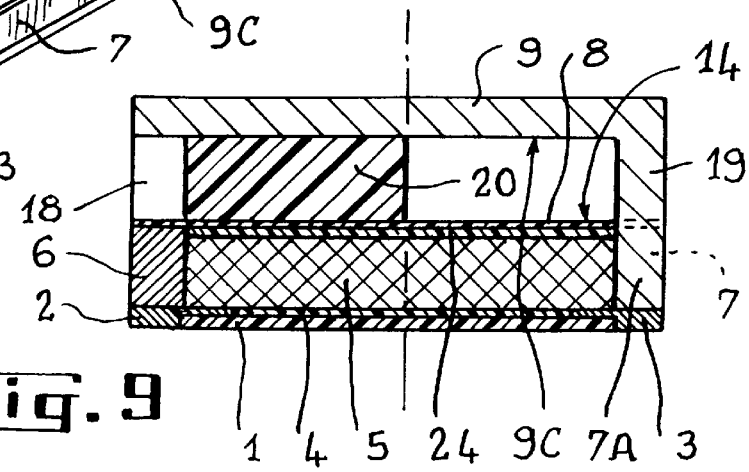

A variant embodiment which intends to reduce such rigidification of the ski to a maximum, is shown in FIGS. 7 to 9.

In this embodiment, the plate or platform 9 is provided to be in one piece with the excrescences 18, 19 and the portions 6A, 7A of the edge elements 6, 7 of the ski.

The plate 9 is borne by these excrescences or feet 18, 19 only by one of its two longitudinal ends 9A, the other end 9B being free and being in overhang, and resting on a shim 20 which is inserted between the lower face 9C of this free end 9B and the upper surface 14 of the ski.

The narrow parts 6A, 7A of the edge elements which comprise the excrescences 18, 19 are connected to the edge elements 6, 7 by gluing or by any other equivalent means.

The shim 20 is preferably made of elastic, or rather-more visco-elastic, material, which gives it considerable freedom of movement and therefore reduces the rigidification of the ski while having an efficient vibration-damping effect.

This shim 20 may also be made of semi-rigid, or oven rigid, material. In order not to rigidify the platform 9, and therefore the ski, it may in that case be fixed, for example glued, only by one of its two large faces, i.e. be fixed only either solely on the lower face 9C of the platform, or solely on the upper face 14 of the ski. It may also be fixed by its two large faces, but via at least one elastic or visco-elastic layer on the two adhering layers.

It should be noted that FIG. 7 is an exploded view for comprehension purposes and not an exploded view of assembly of the elements: it is obvious that the monobloc assembly 9, 18, 19, 6A, 7A is placed in the manufacturing mold before the remaining parts 6, 7 of the edge elements as well as the decorative layer 8 are laid therein.

In the embodiment according to FIGS. 7 to 9, where the overhang 9B of the platform 9 is oriented towards the front of the ski, the platform 9 is always centered in the binding mounting area, so that the portions of edge element 7A and 6A which are in the present case symmetrical with respect to their single excrescence 19 and 18, are in fact offset towards the rear of the ski with respect to this runner zone.

This is in no way compulsory and parts 6A and 7A may very well be disymmetrical with respect to their excrescences 18 and 19, remaining, at least to a large extent, included in the runner zone.

Concerning the embodiment illustrated in FIGS. 7 to 9, it is not absolutely indispensable for the platform 9 to be made in one piece with the portions of edge element 6A, 7A and their excrescences 18, 19.

Figure 10:
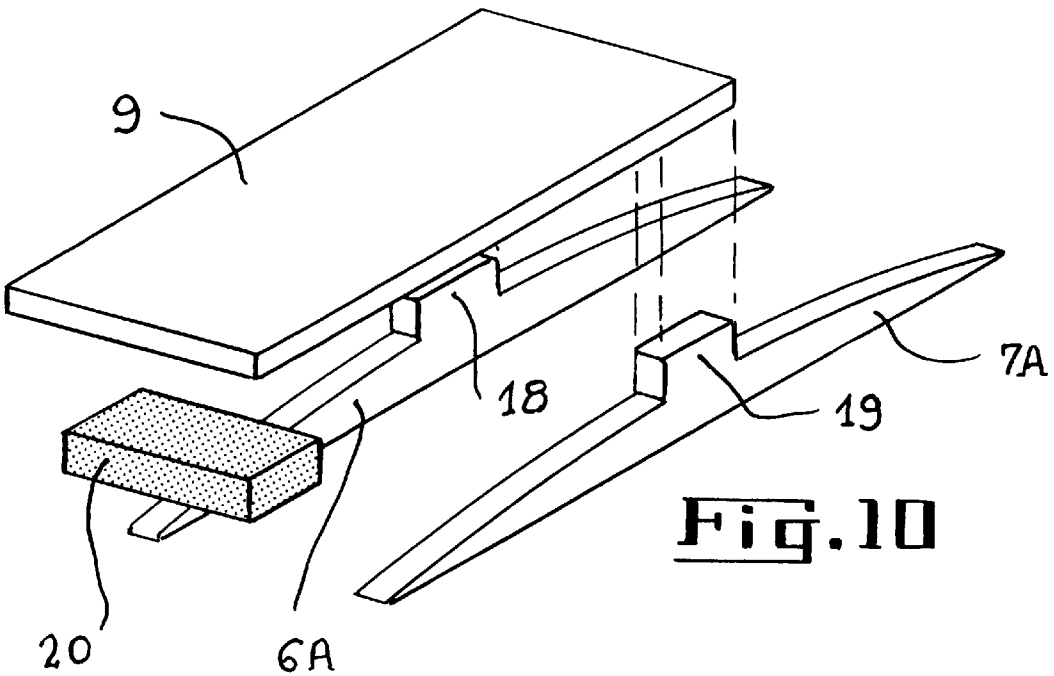
FIGS. 10 and 11 are, respectively, a partial exploded view in perspective and a side view of the binding mounting area of a ski which is a variant of the ski according to FIGS. 7 to 9.
Figure 11:
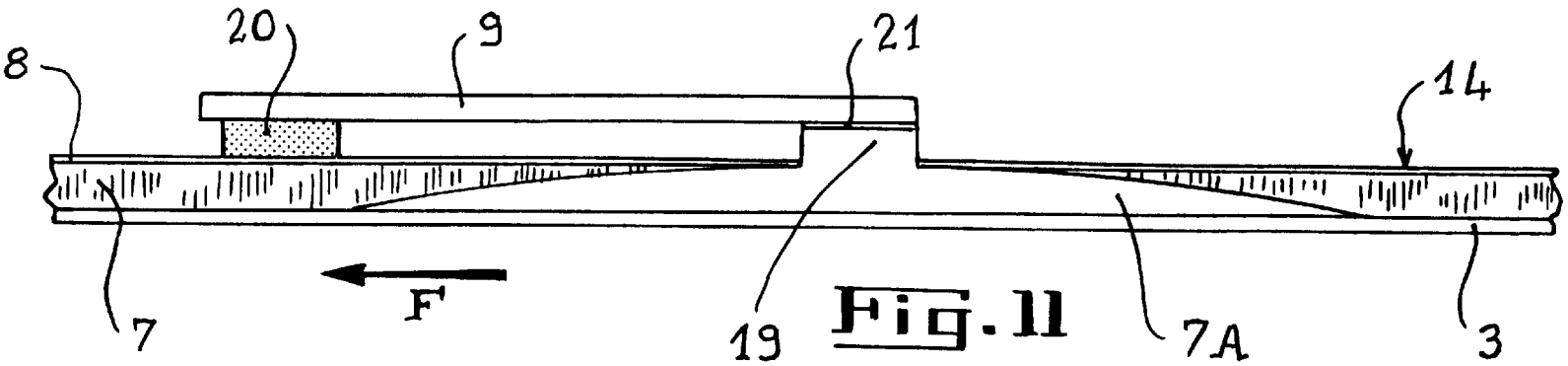

In this respect, FIGS. 10 and 11 illustrate a variant embodiment for which the plate 9 is added, for example by gluing (possibly with the aid of an elastic or visco-elastic layer 21), on these two excrescences 18 and 19.

For greater clarity, the front part of the ski is indicated by an arrow F in FIG. 11.

Other variants of the forms of embodiment according to FIGS. 7 to 9 may be envisaged.

Figure 12:
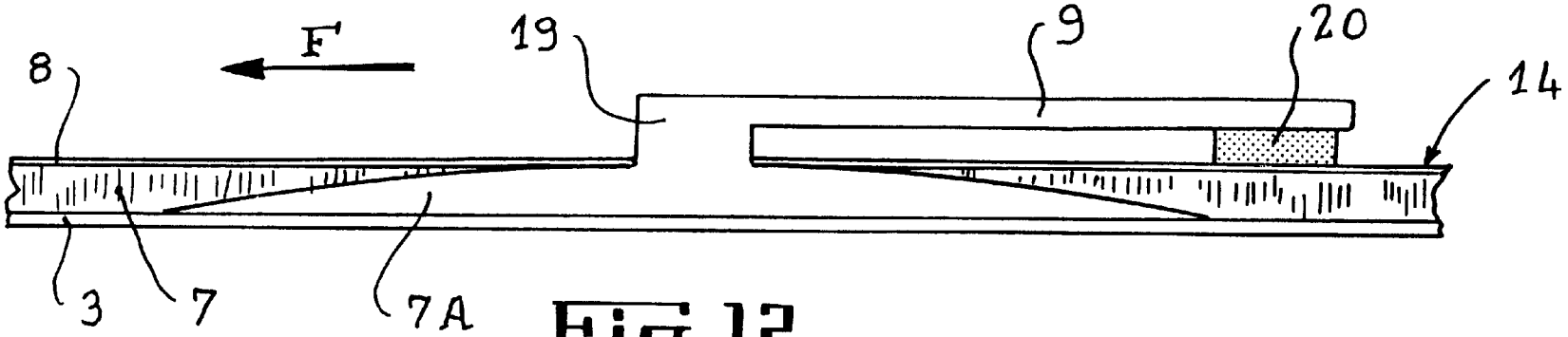
FIGS. 12 and 13 are both views similar to FIG. 11, and illustrating two other variants of the ski according to FIGS. 7 to 9.

On this subject, FIG. 12 shows an embodiment similar to that of FIG. 8, but for which the overhang 9B of the platform 9 is oriented towards the rear of the ski. The portions of edge element 6A and 7A are in that case offset towards the front of the ski with respect to the binding mounting area which contains the platform 9.

Figure 13:
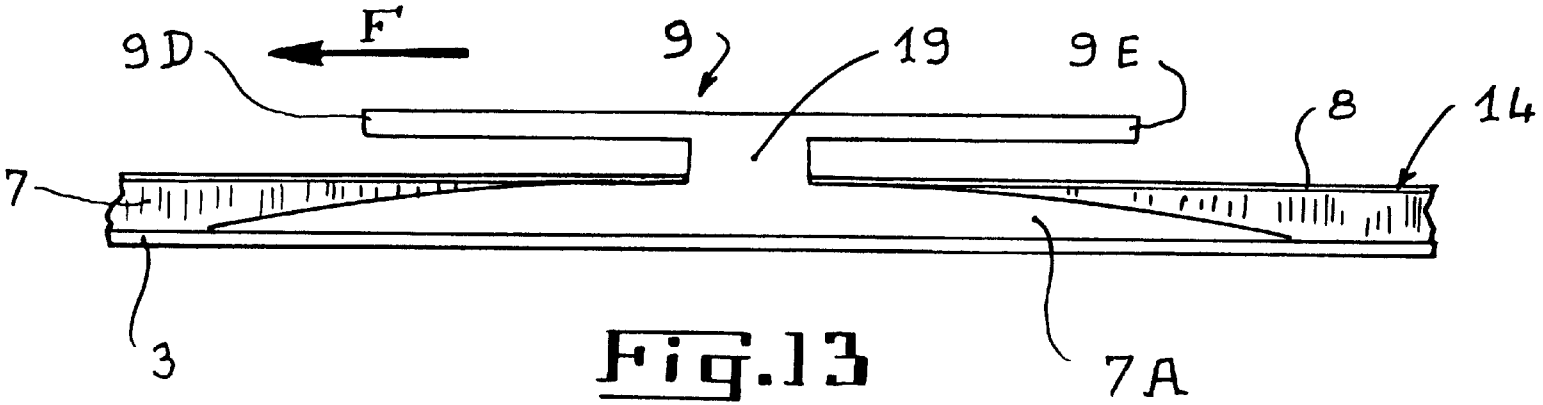

According to FIG. 13, the monobloc assembly 7A, 6A, 18, 19, 9 is totally symmetrical, longitudinally, with respect to the excrescences 18, 19, with the result that this monobloc assembly is centered in the binding mounting area and that the platform 9, which is also symmetrical longitudinally with respect to the excrescences 18 and 19, is composed of two parts in overhang and of the same dimensions: a part 9D directed towards the front of the ski and a part 9E directed towards the rear of the ski.

For the embodiment according to this FIG. 13, it is possible not to provide support shims, similar to shim 20 of FIG. 8, between the overhanging parts 9D, 9E and the upper surface of the ski; such shims may, in any case, always be added by the retailer if the skier so wishes.

It goes without saying that the invention is not limited to the embodiments which have just been described. For example, the excrescences of the edge elements of the ski or other snow board may be disymmetrical, from one edge element to the other, with respect to the median longitudinal plane of the ski, i.e. with respect to the plane orthogonal to the sliding sole and passing through the median longitudinal axis of the ski. In particular, in order to maintain bendability of the ski, fewer excrescences may be provided, therefore fewer feet for the platform, or shorter excrescence length, on the inner side of the ski when the two skis are on the skier's feet, than on the other side (or outer side).

Likewise, the platform 9 may itself be the base, conventionally made in the form of a slideway, for the binding of the boot, this platform and slideway therefore receiving the body of the front stop and/or heel of the binding.

In fact, it is known that a conventional binding generally comprises a base forming a slideway, and therefore with a cross-section in the term of a "closed U", this base enabling the body of the binding (front stop and/or heel) to slide longitudinally towards the front or towards the rear in order in particular to adjust the binding as a function of the skier's boot size. According to this particular feature of the invention, it is therefore this elevating platform 9 which also serves as slideway.

The snow board considered is not necessarily provided with metal edges. It may very well be a snow board or the like not presenting edges on its lower lateral arrises, as is the case at the present time for a large majority of cross-country skis.

What is claimed is:

1. A board for sliding on snow, comprising:

a board having upper, lower and lateral edge surfaces, with said lateral edge surfaces comprised at least in part by rigid left and right lateral edge elements located in, at least, a binding mounting region of the board, said lateral edge elements each including at least one excrescence projecting upwardly above the uppermost surface of said board; and a rigid platform located above and mounted on said excrescences for receiving a binding for a boot.

2. The board of claim 1, wherein said platform is mounted directly on said excrescences.

3. The board of claim 1, wherein a layer of elastic or visco-elastic material is disposed between said platform and excrescences.

4. The board of claim 1, wherein said platform, said excrescences and a portion of said rigid lateral elements comprise an integral piece.

5. The board of claim 1, wherein each of said rigid lateral elements comprises only one excrescence for supporting said platform.

6. The board of claim 5, wherein said platform overhangs said excrescences forward or backwards.

7. The board of claim 6, wherein said platform is, longitudinally, positioned substantially on one side either forward or backwards of said excrescences, and a shim is disposed between the end of the overhang and the upper surface of the board.

8. The board of claim 7, wherein said shim is fixed only on one of its two principle faces.

9. The board of claim 7, wherein said shim is fixed, by at least one of its two principle faces, via at least one elastic or visco-elastic layer.

10. The board of claim 1, wherein said excrescences are disymmetrical, from one lateral element to the other, with respect to the median longitudinal plane of the board.

11. The board of claim 10, wherein said board is a ski, and on the inner side of this ski, with respect to a skier's foot, there are fewer excrescences, or an excrescence of shorter length, than on the outer side of this ski.

12. The board of claim 1, wherein an upper layer of the board is interrupted locally to provide space for said excrescences.

13. The board of claim 1 wherein the excrescences have planar upper surfaces which support said platform.

14. The board of claim 1 which additionally comprises an upper protective and decorative layer whose upper surface comprises said upper surface of the board.

* * * * *